United States Patent [19]

Thatcher

[11] 4,083,499

[45] Apr. 11, 1978

[54] CIGARETTE PACKAGE RIPPER WITH RECYCLING AIR LEG

[75] Inventor: Richard Eugene Thatcher, Chester, Va.

[73] Assignee: Philip Morris Incorporated, New York, N.Y.

[21] Appl. No.: 741,598

[22] Filed: Nov. 15, 1976

[51] Int. Cl.[2] ..... B02C 23/12

[52] U.S. Cl. ..... 241/24; 241/52; 241/79; 241/80; 131/96; 209/136

[58] Field of Search ..... 209/136, 137, 138, 139, 209/140, 141; 131/96; 241/24, 52, 55, 79, 79.1, 80

[56] References Cited

U.S. PATENT DOCUMENTS

| | | | |
|---|---|---|---|
| 2,667,174 | 1/1954 | Eissmann | 241/80 |
| 3,310,059 | 3/1967 | Grinzinger | 241/52 |
| 3,834,630 | 9/1974 | Nelson | 241/24 |

*Primary Examiner*—Granville Y. Custer, Jr.
*Attorney, Agent, or Firm*—Arthur I. Palmer, Jr.; G. Esler Inskeep; Susan A. Hutcheson

[57] ABSTRACT

The invention relates to a method and apparatus for opening packaged articles, particularly packs and cartons of cigarettes, in which such items are ripped open and broken apart sufficiently to allow the contents, e.g. tobacco, to be separated and recovered. The apparatus aspects of this invention involve a ripper fan, a recycling air leg, and a cyclone separator from which the materials are recovered for further processing.

6 Claims, 3 Drawing Figures

CIGARETTE PACKAGE RIPPER WITH RECYCLING AIR LEG

BACKGROUND OF THE INVENTION

The present invention relates to a method and apparatus for ripping open cigarette cartons, packs, and individual cigarettes in preparation for reclaiming the tobacco. Because of inconsistencies in quantities of tobacco in the stream from which the cigarettes are manufactured, some cigarettes are produced which contain less or more tobacco than the desired amount, and hence are not acceptable as consumer products. For this reason, and because of other manufacturing processes that cause cigarettes or their packaging to be below the desired standards, some cigarettes are rejected for sale to the consumer.

Also, in the tobacco industry, cigarette packages and cartons containing usable tobacco are returned because the shelf-life may have been greater than that advised by the supplier.

A sizable amount of tobacco (an expensive commodity) must be destroyed unless it can be reclaimed. The usual method of destruction is by incineration. That method causes great loss of valuable quantities of tobacco which in the interests of economy should be reclaimed.

The present invention affords a reliable and effective way of breaking open the carton, the packs, and the cigarette wrappers so that the tobacco contents can be reused.

Heretofore, on the whole, packs, cartons, and cigarettes have been opened separately and the tobacco removed by manual labor, a time-consuming, expensive, and tedious means of reclaiming the tobacco. Another method sometimes used was to thoroughly soak the packages, cartons, and tobacco in water and to then rotate the mass in a sieve-like drum. During this process, the paper, filters, and tobacco would separate and form into ball-like clumps. The tobacco filler was recovered by selectively hand-removing it from the other clumped materials.

Several proposals have involved shredding the cigarettes and subsequently recovering the tobacco from the shreds. These suffer the disadvantage that the tobacco is fragmented excessively thereby damaging its filling power on subsequent recycle. Also, shredding the tobacco and its packaging into similarly sized pieces makes it more difficult to achieve separation.

U.S. Pat. No. 3,757,799 deals with the reclamation of tobacco from cigarettes by first radially compressing the tobacco in the cigarette wrapper and subsequently blowing the compressed tobacco out of the wrapper.

U.S. Pat. No. 3,103,222 discloses a process by which the cigarette paper is slit, the filter held by pins, and the cigarette moved past an air station where air blows the tobacco out from the cigarette wrapper.

U.S. Pat. No. 3,164,548 involves an apparatus for separating heavy and light particles (particularly stems and leaf material) from each other in a tower-type separator, into which the materials are thrown vertically at high velocity across a rising current of air. The lighter particles float upward in the tower and pass from it into a tangential separator. The heavier materials fall onto a vibrating screen and exit through a discharge tube.

SUMMARY OF THE INVENTION

In the present invention packaged cigarettes are moved by a conveyor, which is motor driven, to the intake of the housing of a ripper fan. The intake opening is located off-center of the axis of the fan to allow the ripper fan blades to hit the cartons or packs so that the packs are broken open.

The conveyor carries the packaged cigarettes up to the fan intake, and the vacuum inside the ripper fan housing rapidly pulls the packs from the conveyor to where they can be hit by the ripper blades. The housing is effective to produce a turbulent area around the fan so that the materials after being hit are tumbled and forced upward, striking breaker pins or rods placed in a triangular array in an upper outlet portion of the ripper fan housing, the triangular arrangement being so placed to prevent a build-up of the broken materials.

The breaker rods serve to further break the larger already partially broken materials. As these materials travel along within the outer periphery of the centrifugal fan housing, they strike the rods. This causes incompletely broken packs to come apart and also separates the cigarettes from their wrappings. These breaker rods and their triangular arrangement have been found effective to assure a 100% pack break, thus avoiding the necessity of repeated recyclings to the ripper fan.

Air control inlet slots which can be regulated if desired by a damper are provided in the fan housing to control the air flow therein, so as to achieve an effective transfer of the broken particles as they move into the recycling leg. The recycling leg may have an observation window to guide the operator as to when and how the air control should be adjusted. The air flow within the leg must be sufficiently turbulent to get tumbling separation, and an air velocity of about 2500 to 3000 feet per minute is generally sufficient. The recycling leg, a continuation of the ripper fan housing, receives the broken materials as they are carried upwardly by the air stream exiting from the ripper fan. The lighter-weight separated materials are then transferred to a cyclone separator, while the heavier materials drop back into the ripper housing for recycling through the ripper fan until they have become light enough to be carried on to the cyclone separator.

Particular features of the recycling leg are important. The product return or recycle side of the leg must be in a straight continuous plane inclined from horizontal at an angle of about 55° to 80° to prevent accumulation of the fragmented materials. The opposite side of the leg must be spaced to provide a broadened portion of the leg in order to allow the broken materials to spread and to separate the particles of the desired size so as to give them room to be carried upward and into the cyclone separator. Thus, for example, the width of the broadened portion should be about twice the width of the inlet throat to the air leg, while the exit tube to the cyclone separator may be as small as about 20% of the width of the throat. Minor adjustments of the length and breadth of the recycling leg and the air velocity can be made to render the apparatus suitable for the winnowing of grains, hulls, nuts, or other materials that require size or weight classification.

The cyclone separator has an air exhaust outlet and dust exhaust duct in its top portion. Controlling the air outlet may be coordinated with operation of air control inlets in the ripper housing to regulate the air flow through the system. The cyclone separator is a commonly used separator or receiver which operates on the vortex principle. It serves to reduce the air velocity and thereby separate the broken materials from the air stream.

BRIEF DESCRIPTION OF THE DRAWINGS

The invention will now be further described with reference to the accompanying drawings in which.

DESCRIPTION OF PRESENTLY PREFERRED EMBODIMENTS AND PRACTICES

Figure 2:
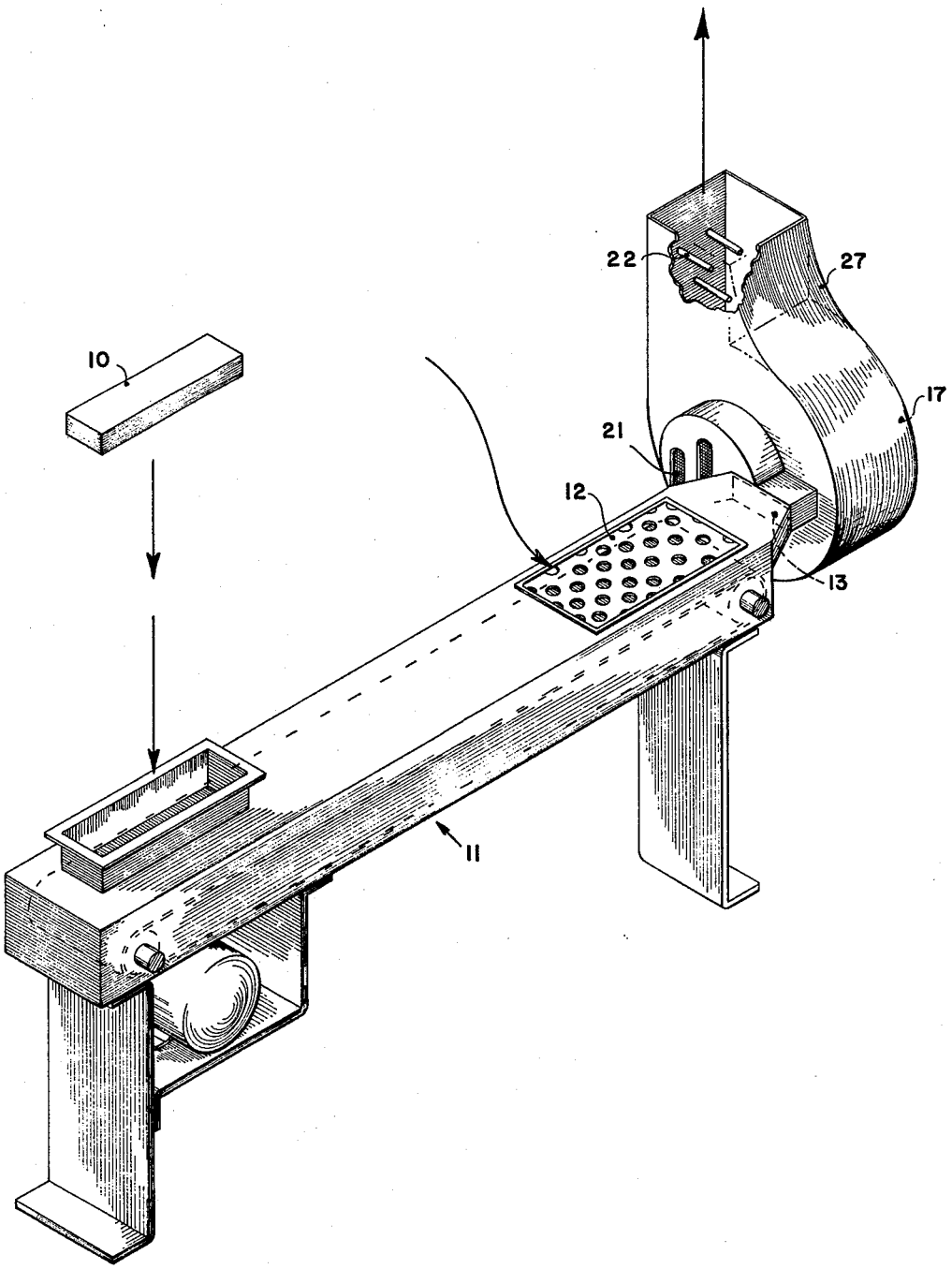
FIG. 2 is a schematic view of the conveyor which carries the package to be ripped to the intake of the ripper housing, also showing portions of the ripper fan housing as adapted for use in accordance with the invention.
Figure 3:
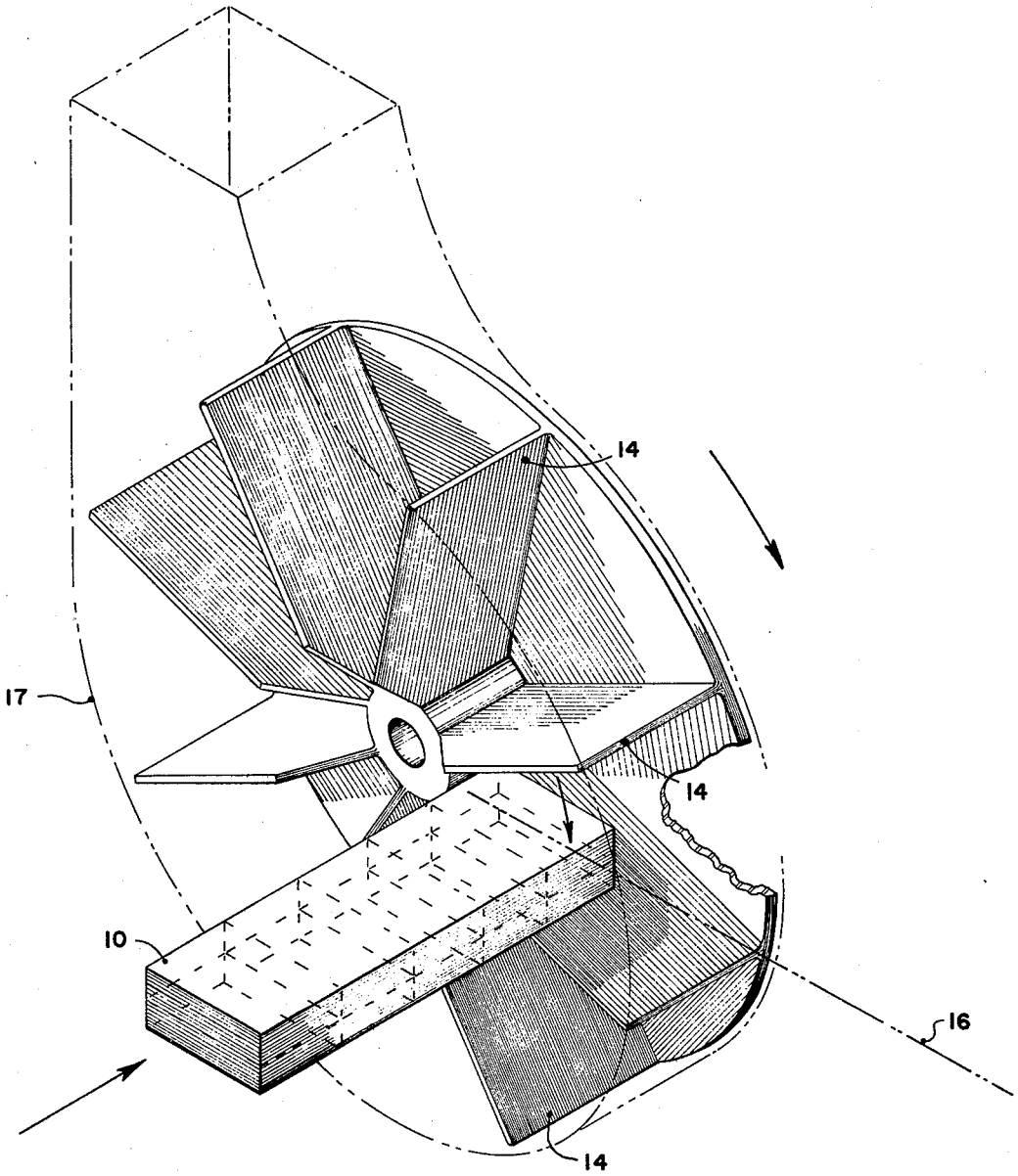
FIG. 3 is a view of the ripper fan as it is used to break open the carton and cigarette packages.

As shown in the several drawings, packaged articles such as cartons or packs or cigarettes 10 are placed on a boxed-in conveyor 11 (FIG. 2) which has an airflow inlet such as a perforated cover plate 12 through which air, from behind the cigarettes, pushes the packaged articles rapidly into the intake 13 of the centrifugal ripper-fan housing 17. When a carton or an individual package of cigarettes reaches the fan intake 13, it is pulled in by the suction of the ripper fan so that the fan impeller blades 14 break the cartons and packs along the plane of impact 16 as shown in FIG. 3. The initial impact in most instances is sufficient to rupture the carton, each pack, and the paper wrappings of the individual cigarettes. The fan ripper is motor driven (details not shown).

Figure 1:
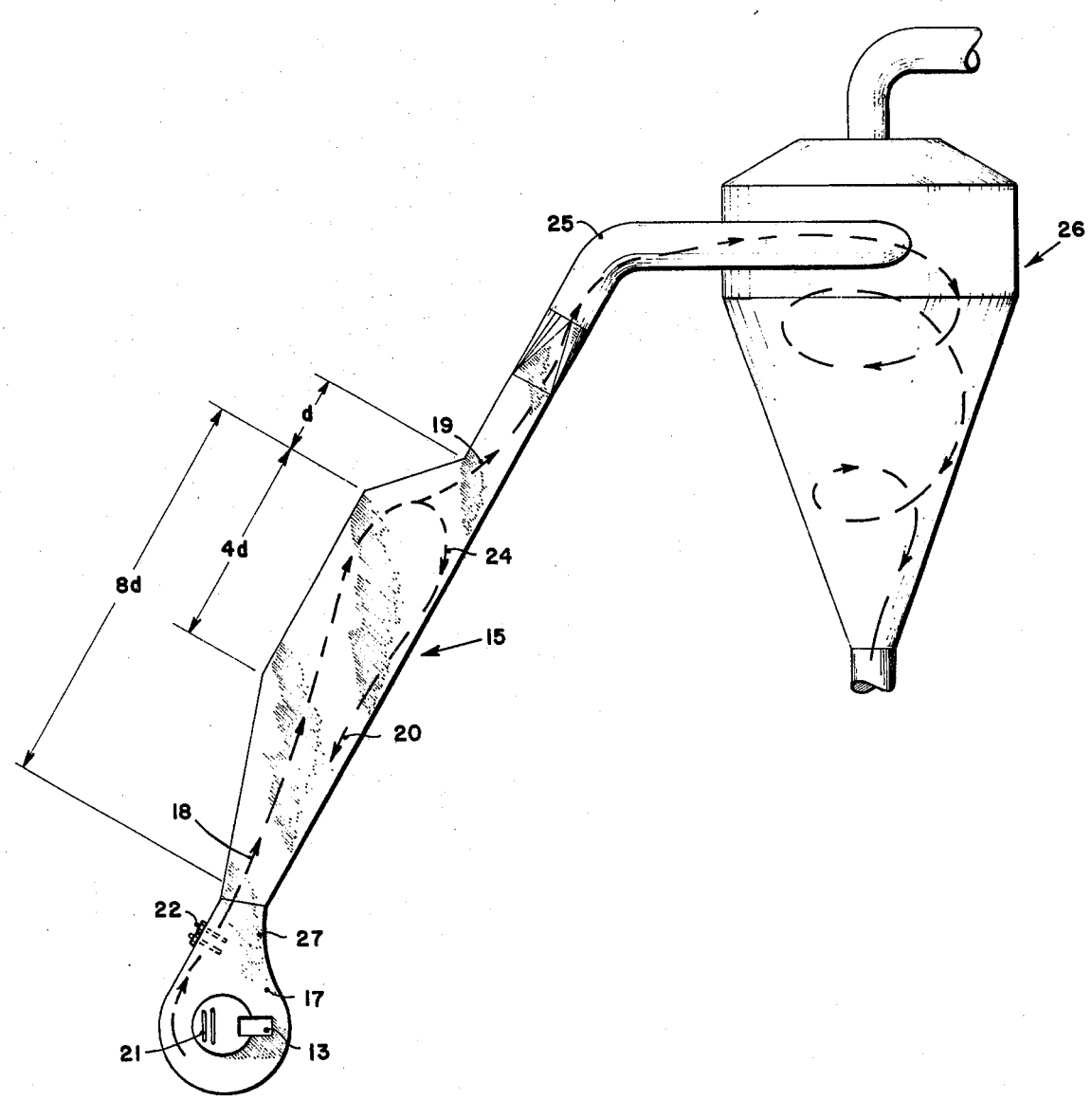
FIG. 1 is a semi-schematic front elevation view of the fan housing, the recycling leg, and the cyclone separator as arranged ian the present invention.

Controlling the air flow in the fan housing 17 and in the air leg separator 15 is accomplished by adjusting the size of vents 21 which may be equipped with a variable damper, thus regulating the air speed to achieve the desired transfer of broken materials along the path 18, 19 or, in the case of recycled materials, along the path 18 and hence downwardly along path 24 (as detailed in FIG. 1).

As the partially ripped or broken materials in the ripper fan housing continue to move along toward the upper outlet of the fan housing, they strike breaker rods 22 (which may protrude inwardly for three or four inches and are preferably so placed as to form a triangular arrangement as shown) and this arrangement serves to further break the already partially ripped or broken packs, causing the individual packs to come apart and thereby separating the cigarettes from their outer wrappings. These materials are then discharged into the air leg separator without further attrition.

The air flow in the leg separator is adjusted to allow the heavier partially broken or unbroken packs to fall out of the air stream and be returned along path 24 to be again submitted to treatment by the ripper fan until they are sufficiently broken apart to be carried upward by air along route 19, and to outlet duct 25 through which the material enters the cyclone receiver 26. The lighter particles that do not have to be recycled have already progressed along route 19, and have similarly entered the cyclone receiver through duct 25. In this cyclone receiver, the air velocity is reduced, so that the product settles and exits from the apparatus for further refining.

It will be appreciated that the air leg separator can be proportioned to match its operation to the particular product being reclaimed. Thus, for example, in processing cigarette cartons, the relative dimensions d, 4d, and 8d are proportioned in those ratios so as to provide a widened portion for the recycling of materials not yet ready to go into the cyclone receiver. Also, the outlet throat 27 of the fan housing is suitably enlarged so the ripped material is released into the air stream and not ground excessively into undesirable, non-usable bits.

I claim:

1. A method for ripping open packaged articles such as cigarette cartons, cigarette packs, or cigarettes to remove the tobacco therein, which comprises the steps of conveying said articles successively to the intake of a ripper fan housing, whereby each such article is pulled by the suction thereof into the impeller blades of said fan and ripped open, transferring the ripped materials from said housing into a leg separator having an inclined section from which portions of said materials are carried upwardly to an outlet, while the heavier portions fall out of the air stream and are returned to said ripper fan until said materials become sufficiently light to be conveyed by the air stream to said outlet for removal.

2. Apparatus for ripping open packaged articles, comprising a ripper fan housing, means for conveying said articles to an intake of said ripper fan housing, said ripper fan providing a vacuum to pull the articles into the blades of said ripper fan which strike and break said articles, breaker rods in an upper outlet portion of said ripper fan housing, a leg separator having an inclined and broadened portion to receive material discharged from said ripper fan and effective to achieve recycling of the relatively coarser and heavier portion thereof, said leg separator having a narrower rounded outlet duct for discharging suitably broken materials.

3. The apparatus of claim 2 in which said housing comprises an intake opening which is placed off-center of the axis of said ripper fan.

4. The apparatus of claim 2 in which said leg separator has an inclined lower surface forming a straight continuous plane at an angle of about 55° –80° from horizontal.

5. The apparatus of claim 2 in which said breaker rods are disposed in a triangular arrangement.

6. In an air leg separator adapted to receive fragments of mixed materials derived from packaged cigarettes or the like, and to discharge the smaller or relatively lighter fragments, the improvement comprising spaced walls defining a broadened portion of the air leg, said walls being generally parallel to each other and inclined at an angle of about 55° –80° from the horizontal, a divergent inlet section leading to the lower end of said broadened portion, a convergent outlet section leading from the upper end of said broadened portion, and means for introducing the fragmented materials into said inlet section entrained in a stream of air, said broadened portion of the leg separator being effective to separate and to transfer said smaller or lighter fragments in the air stream to said outlet while allowing the heavier and larger fragments to fall back toward said inlet.

* * * * *

UNITED STATES PATENT AND TRADEMARK OFFICE

CERTIFICATE OF CORRECTION

PATENT NO. : 6,083,499

DATED : July 4, 2000

INVENTOR(S) : Narva *et al.*

It is certified that error appears in the above-identified patent and that said Letters Patent is hereby corrected as shown below:

Column 15, line 63: "4fold" should read --4-fold--.

Column 48, line 62, Claim 17: "PS167II2" should read --PS167H2--.

Column 49, line 2, Claim 19: "PS167II2" should read --PS167H2--.

Column 49, line 31, Claim 30: "clam" should read --claim--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*